US006874168B1

(12) United States Patent
Kuhuski

(10) Patent No.: US 6,874,168 B1
(45) Date of Patent: Apr. 5, 2005

(54) BUTTOCKS PADDED PANTS AND NUMBERED APPAREL

(76) Inventor: Larry D Kuhuski, 6100 E. 41st Ct. #1, Anchorage, AK (US) 99504

( * ) Notice: Subject to any disclaimer, the term of this patent is extended or adjusted under 35 U.S.C. 154(b) by 0 days.

(21) Appl. No.: 10/747,762

(22) Filed: Dec. 30, 2003

(51) Int. Cl.[7] ..... A41D 13/00
(52) U.S. Cl. ..... 2/227
(58) Field of Search ..... 2/456, 267, 238, 2/455, 404, 406, 407, 465, 227, 79, 228, 403

(56) References Cited

U.S. PATENT DOCUMENTS 4,894,867 A * 1/1990 Ceravolo et al. ..... 2/238
5,068,920 A * 12/1991 Bray ..... 2/456
5,842,232 A * 12/1998 Parrish ..... 2/400
5,957,692 A * 9/1999 McCracken et al. ..... 434/159
6,041,437 A * 3/2000 Barker et al. ..... 2/82
6,175,963 B1 * 1/2001 Loeffelholz ..... 2/209.13
6,182,297 B1 * 2/2001 Duren et al. ..... 2/228
6,532,599 B1 * 3/2003 Dugan ..... 2/228
6,550,066 B1 * 4/2003 Brassey ..... 2/93
6,715,158 B1 * 4/2004 Hay ..... 2/456

* cited by examiner

*Primary Examiner*—Tejash Patel
(74) *Attorney, Agent, or Firm*—Michael I. Kroll

(57) ABSTRACT

The present invention 10 discloses pants 16 having foam padding 18 inserted into the pants seat as a cushion. The padding 18 is in the form of a buttocks 20 extending partially through the thigh area. The pants 16 can be either trousers or shorts manufactured from any material such as, spandex, lycra, polyester/cotton, cotton, cotton denim, etc., and can be manufactured in a style matching a sports team colors or can incorporate graphic images such as team logo 26 or other indicia. The aforementioned apparel can also be manufactured with a unique serial number 28 whereby sporting event promoters or other interested parties could manufacture and/or sell numbered apparel whereby attendance to events can be promoted by offering prizes for the wearers of the apparel by randomly drawing from a reservoir of numbers and awarding prizes for those in attendance. The present invention 10 also provides for an additional element wherein in addition to the padded pants being numbered, hats 30, sweatshirts and jackets 32 could also be manufactured with a serial number 28 whereby the wearers could participate in a sporting event attendance contest which has the potential to increase gate receipts for the stadium.

5 Claims, 9 Drawing Sheets

BUTTOCKS PADDED PANTS AND NUMBERED APPAREL

BACKGROUND OF THE INVENTION

1. Field of the Invention

The present invention relates generally to clothing and, more specifically, to pant having foam padding inserted into the pants seat as a cushion. The padding is in the form of a buttocks extending partially through the thigh. The pants can be either trousers or shorts manufactured from any material such as, spandex, lycra, polyester/cotton, cotton, cotton denim, etc, and can be manufactured in a style matching a sports team colors or incorporate graphic images such as team logo or other indicia. The aforementioned apparel can also be manufactured with a unique serial number whereby sporting event promoters or other interested parties could manufacture and/or sell numbered apparel whereby attendance to events can be promoted by offering prizes for the wearers of said apparel by randomly drawing from a reservoir of numbers and awarding prize for those in attendance.

The present invention provides for an additional element wherein in addition to the padded pants being number, hats, sweatshirts and jackets could also be manufactured with a serial number whereby the wearers can participate in a sporting event attendance contest which has the potential of increase gate receipts for the stadium.

2. Description of the Prior Art

While there are cushions that can be used to provide comfort to the users while attending sporting events which may be suitable for the purposes for which they were designed, they would not be as suitable for the purposes of the present invention, as hereinafter described.

It is therefore felt that a need exists for a padding item which forms an integral part of pants, whether trousers or shorts that will provide padding for the users while sitting during an event.

Furthermore, manufacturing the padding item in the form of an oversized buttocks provides a humorous and novel method of providing said cushioning.

SUMMARY OF THE PRESENT INVENTION

The present invention discloses pants having foam padding inserted into the pants seat as a cushion. The padding is in the form of a buttocks extending partially through the thigh area. The pants can be either trousers or shorts manufactured from any material such as, spandex, lycra, polyester/cotton, cotton, cotton denim, etc., and can be manufactured in a style matching a sports team colors or can incorporate graphic images such as team logo or other indicia. The aforementioned apparel can also be manufactured with a unique serial number whereby sporting event promoters or other interested parties could manufacture and/or sell numbered apparel whereby attendance to events can be promoted by offering prizes for the wearers of the apparel by randomly drawing from a reservoir of numbers and awarding prizes for those in attendance. The present invention also provides for an additional element wherein in addition to the padded pants being numbered, hats, sweatshirts and jackets could also be manufactured with a serial number whereby the wearers could participate in a sporting event attendance contest which has the potential to increase gate receipts for the stadium.

A primary object of the present invention is to provide pants with padding that can be used as a cushion while seated.

Another object of the present invention is to provide said padding in the form of an oversized buttocks.

Yet another object of the present invention is to provide pants having said buttocks positioned in the seat of the pants.

Still yet another object of the present invention is to provide said buttocks-shaped padding in either long or short pants.

Another object of the present invention is to provide pants wherein said padding forms an integral part of said pants.

Yet another object of the present invention is to provide said pants in colors that match one or more colors of a favored team.

Still yet another object of the present invention is to provide said pant made from materials such as, spandex, lycra, polyester/cotton, cotton, cotton denim.

Another object of the present invention is to provide said pants having a logo of a favored team.

Yet another object of the present invention is to provide said pants with indicia or advertisements imprinted thereon.

Still yet another object of the present invention is to provide said pants with a unique serial number.

Another object of the present invention is to provide other apparel such as hats, sweatshirts and jackets manufactured with a unique serial number.

Yet another object of the present invention is to provide said apparel with a unique serial number whereby sporting event sponsors can use said serial numbers to engage in a game having rewards for attending said event with said uniquely numbered apparel.

Additional objects of the present invention will appear as the description proceeds.

The present invention overcomes the shortcomings of the prior art by providing pants having foam padding inserted into the seat as a cushion. The padding is in the form of a buttocks extending partially through the thigh. The pants can be either trousers or shorts manufactured from any material such as, spandex, lycra, polyester/cotton, cotton, cotton denim, etc, and can be manufactured in a style matching a sports team colors or incorporate graphic images such as team logo or other indicia. The aforementioned apparel can also be manufactured with a unique serial number whereby sporting event promoters or other interested parties could manufacture and/or sell numbered apparel whereby attendance to events can be promoted by offering prizes for the wearers of said apparel by randomly drawing from a reservoir of numbers and awarding prize for those in attendance.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
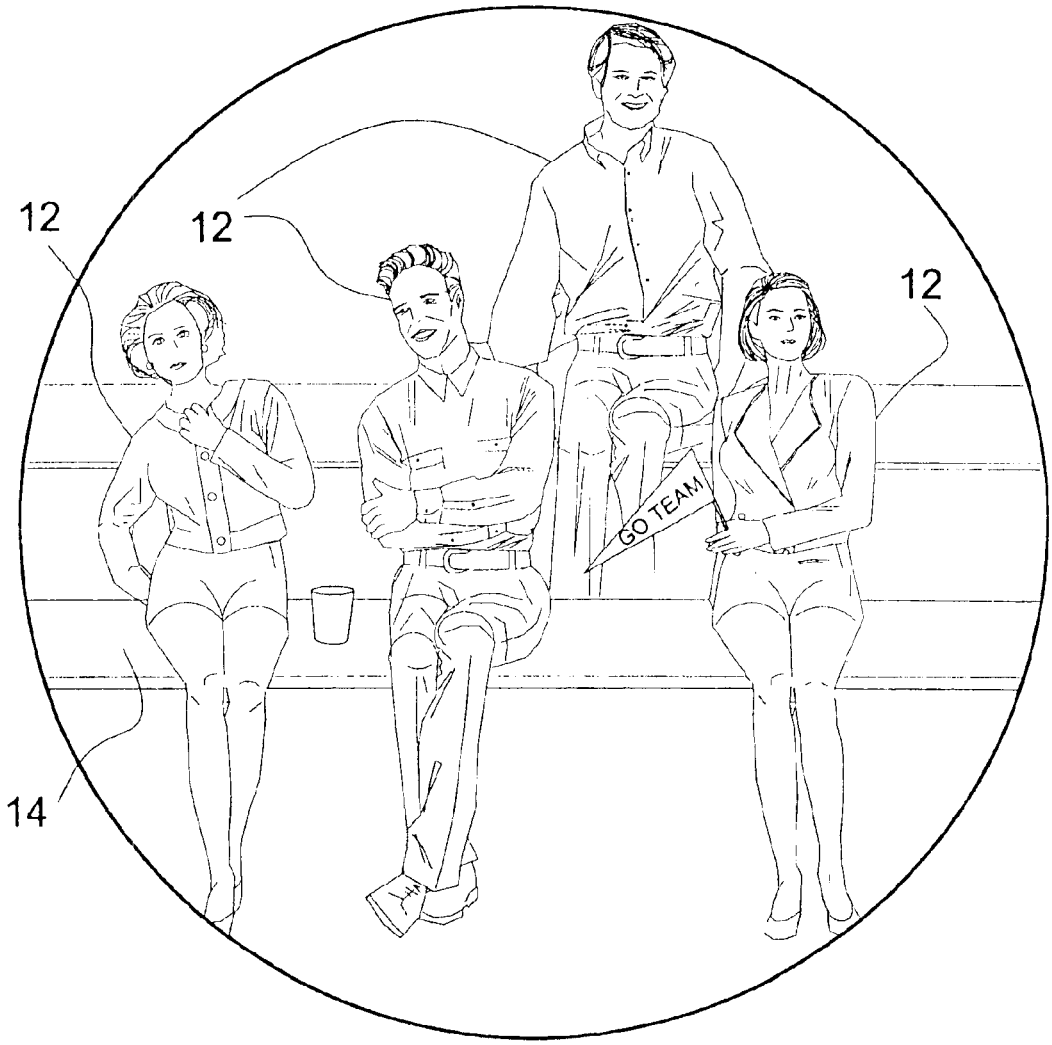
FIG. 1 is an illustrative view of prior art.

With regard to reference numerals used, the following numbering is used throughout the drawings.

10 present invention

12 user

14 seat

16 pants

18 cushion

20 buttocks and thighs

22 inner material

24 outer material

26 logo

28 number

30 cap

32 jacket

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of users 12 wearing the prior art clothing. Sports events at stadiums usually mean sitting on bleacher seats 14 that are hard and extremely uncomfortable for any extended period of time. Many spectators 12 carry cushions to place on the bleacher 14 seat to provide a more comfortable seat. The present invention overcomes the shortcomings of the prior art by providing pants with built in cushions for the buttocks and thighs. The pants would provide comfort for the wearer and could be worn for a wide variety of sporting events, such as NASCAR, football, basketball, soccer, baseball and hockey. The pants of the present invention would be marketed to consumers of all ages. The cushioned pants are made for all weather conditions using a variety of materials such as spandex, lycra, polyester/cotton, cotton, cotton denim and others. The pants will be provided in full length or shorts and can be accompanied by a matching cap and/or jacket.

Figure 2:
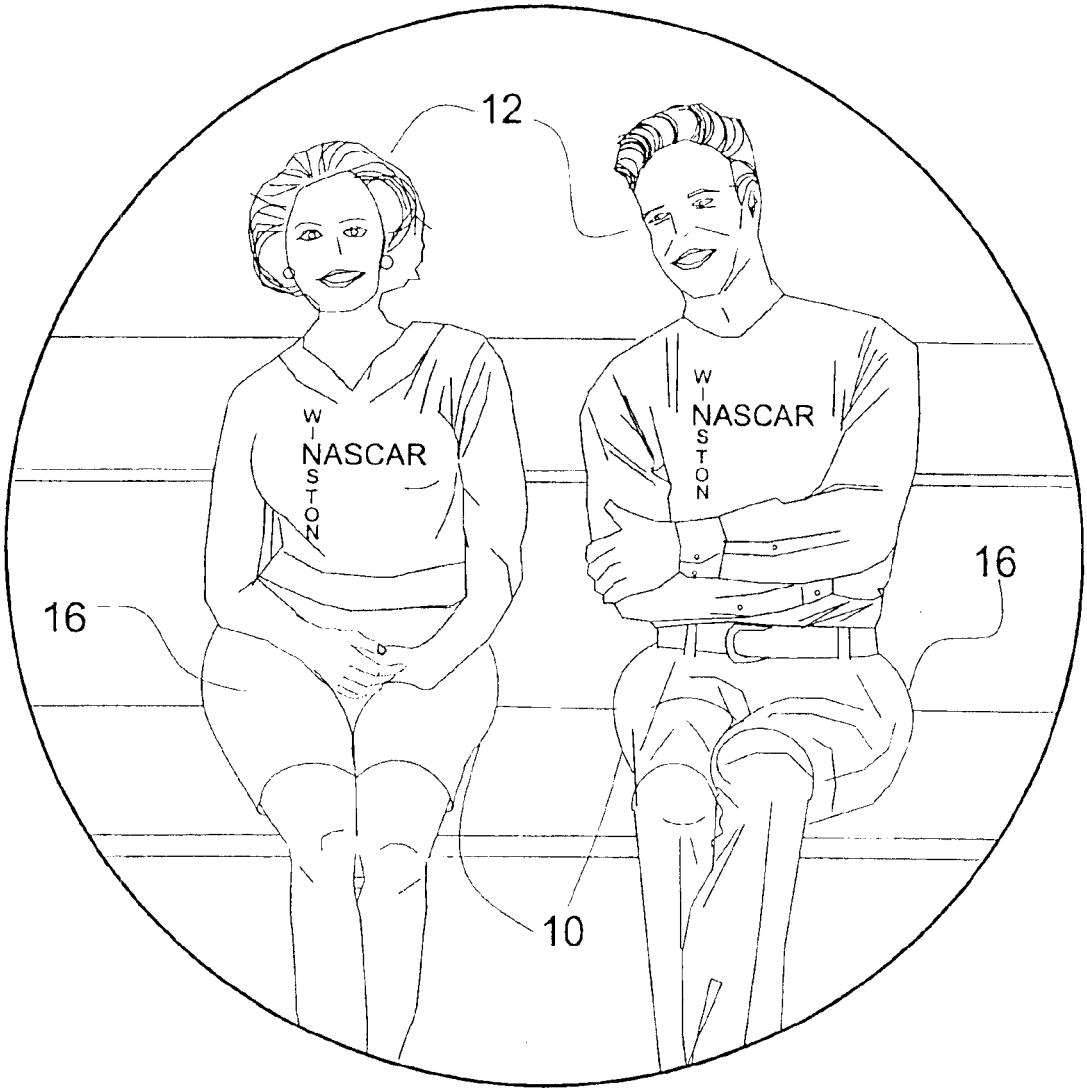
FIG. 2 is an illustrative view of the cushioned pants of the present invention.

Turning to FIG. 2, shown therein is an illustrative view of the cushioned pants of the present invention 10. The present invention 10 provides pants 16 with built in cushions for the buttocks and thighs. The pants 16 provide comfort for the wearer 12 and could be worn for a wide variety of sporting events, such as NASCAR, football, basketball, soccer, baseball and hockey. The pants 16 of the present invention 10 would be marketed to consumers of all ages. The cushioned pants 16 are made for all weather conditions using a variety of materials such as spandex, lycra, polyester/cotton, cotton, cotton denim and others. The pants 16 will be provided in full length or shorts and can be accompanied by a matching cap and/or jacket. In addition, the pants 16 could comprise team colors and logo printed on the outer material of the pants like an advertisement. The pants 16 can also consist of a set of numbers identifying the wearer. For example; if at a football game, a spectator has their team pants on, and that team wins the game a number is drawn, and the winner is the fan with that number marked on their pants. If that team goes to the super bowl and wins, and your number is drawn, the winner could receive a prize. This can be done at any sports event.

Figure 3:
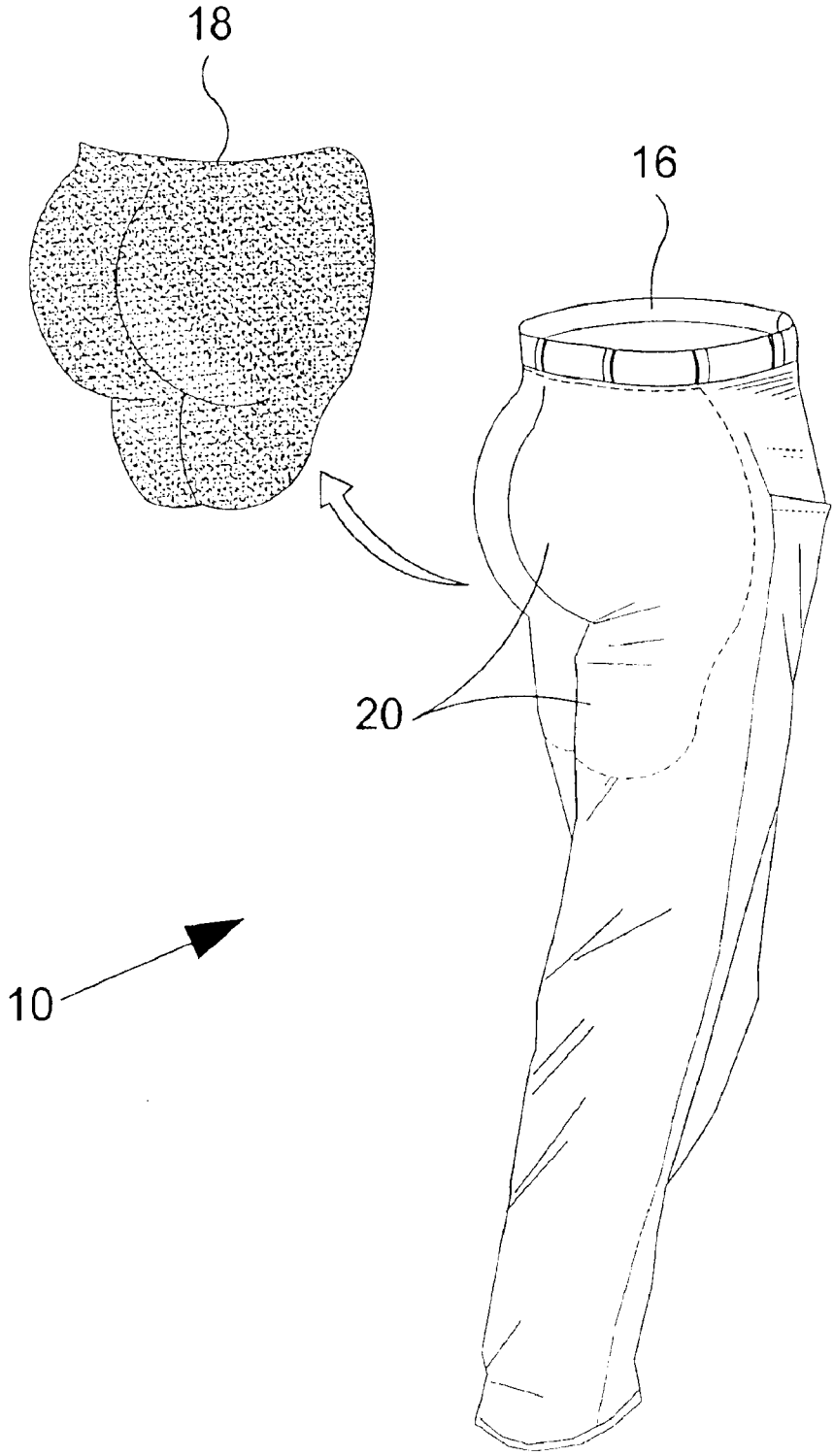
FIG. 3 is an illustrative view of the cushioned pants of the present invention.

Turning to FIG. 3, shown therein is an illustrative view of the cushioned, full-length pants 16 of the present invention 10. The present invention 10 provides pants 16 with built in cushions 18 for the buttocks and thighs 20 of the pants. The cushioned pants 16 are made for all weather conditions using a variety of materials such as spandex, lycra, polyester/cotton, cotton, cotton denim and others. The pants 16 will be provided in full length or shorts and can be accompanied by side pockets, waist band, rear pockets and foam rubber cushions 18 to protect the buttocks and thighs, and with team logo with a message announcing support for the team or advertisements.

Figure 4:
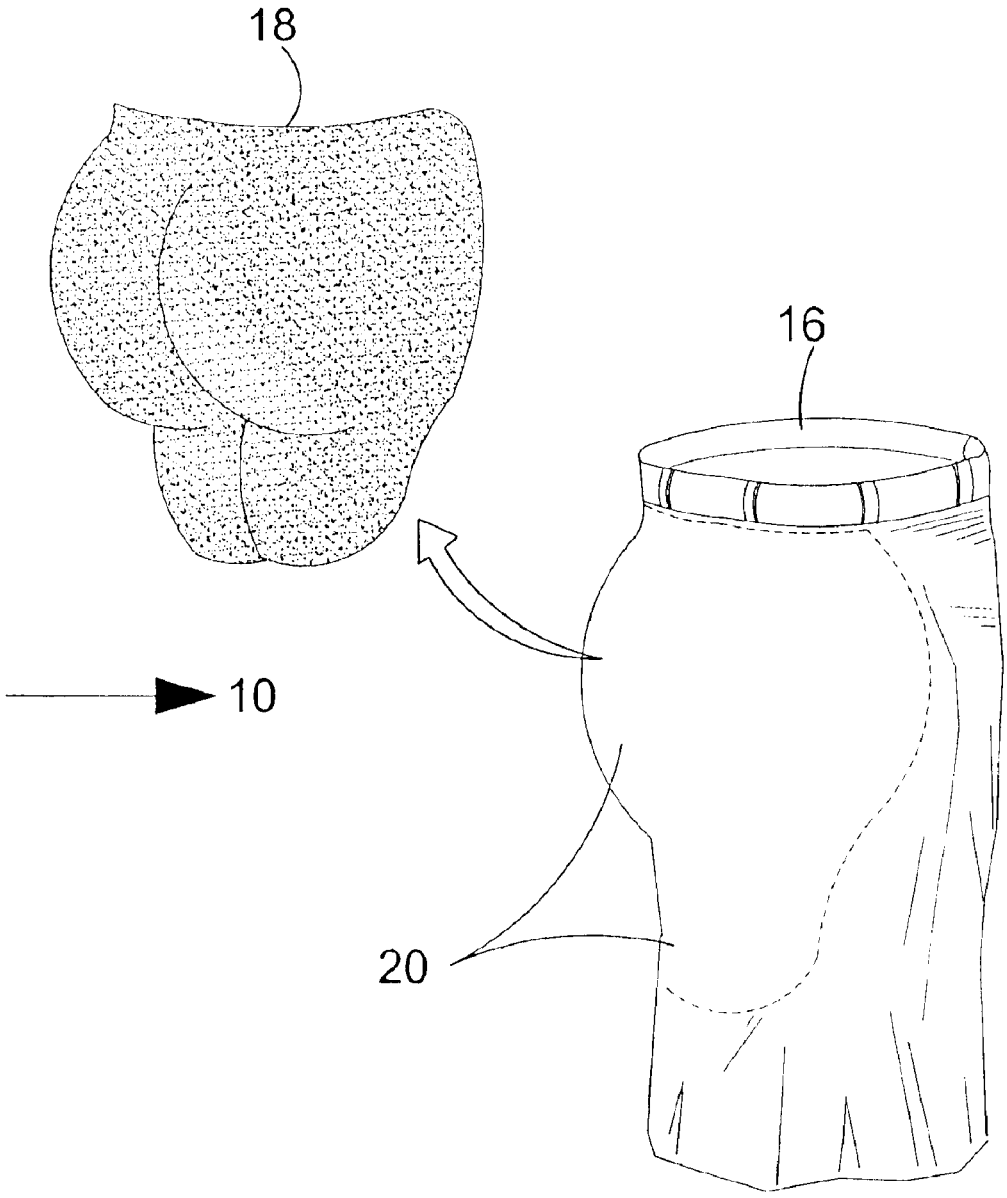
FIG. 4 is an illustrative view of the cushioned pants of the present invention.

Turning to FIG. 4, shown therein is an illustrative view of the cushioned short pants 16 of the present invention 10. The cushioned pants 16 of the present invention 10 is formed of a pair of appropriately sized pants or shorts having a formed cushioning element 18 taking the shape of a large buttocks that is fixed to the interior of the pants 16 whereby the wearer is provided with a cushioning element 18 for their buttocks and thighs 20. The pants 16 while serving the practical purpose of a cushion 18, also serve as a whimsical entertainment and can be accompanied by indicia and logos serving team support or advertisements.

Figure 5:
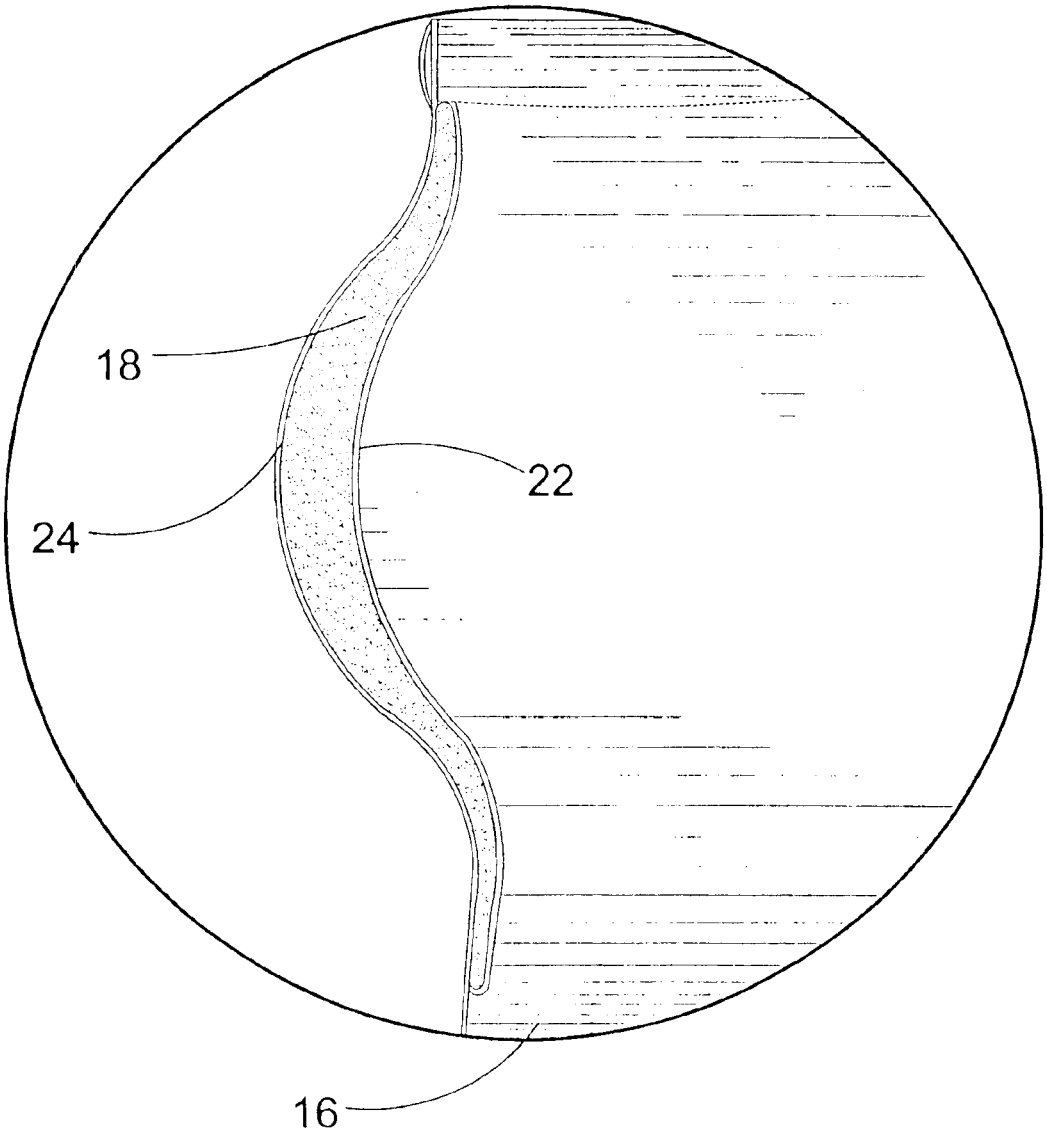
FIG. 5 is a sectional view of the cushioned pants of the present invention.

Turning to FIG. 5, shown therein is a sectional view of the cushioned pants 16 of the present invention. Shown is a sectional view of apparel, either pants or shorts, comprised of a predetermined material such as spandex, lycra, polyester/cotton, cotton, cotton denim, etc., with a buttocks-shaped foam rubber cushion or layer 18 fixedly attached between the interior 22 and exterior 24 layers of pants material. The cushion 18 is positioned approximate the seat of the apparel 16 forming a cushion for the wearer when the wearer is in a seated position.

Figure 6:
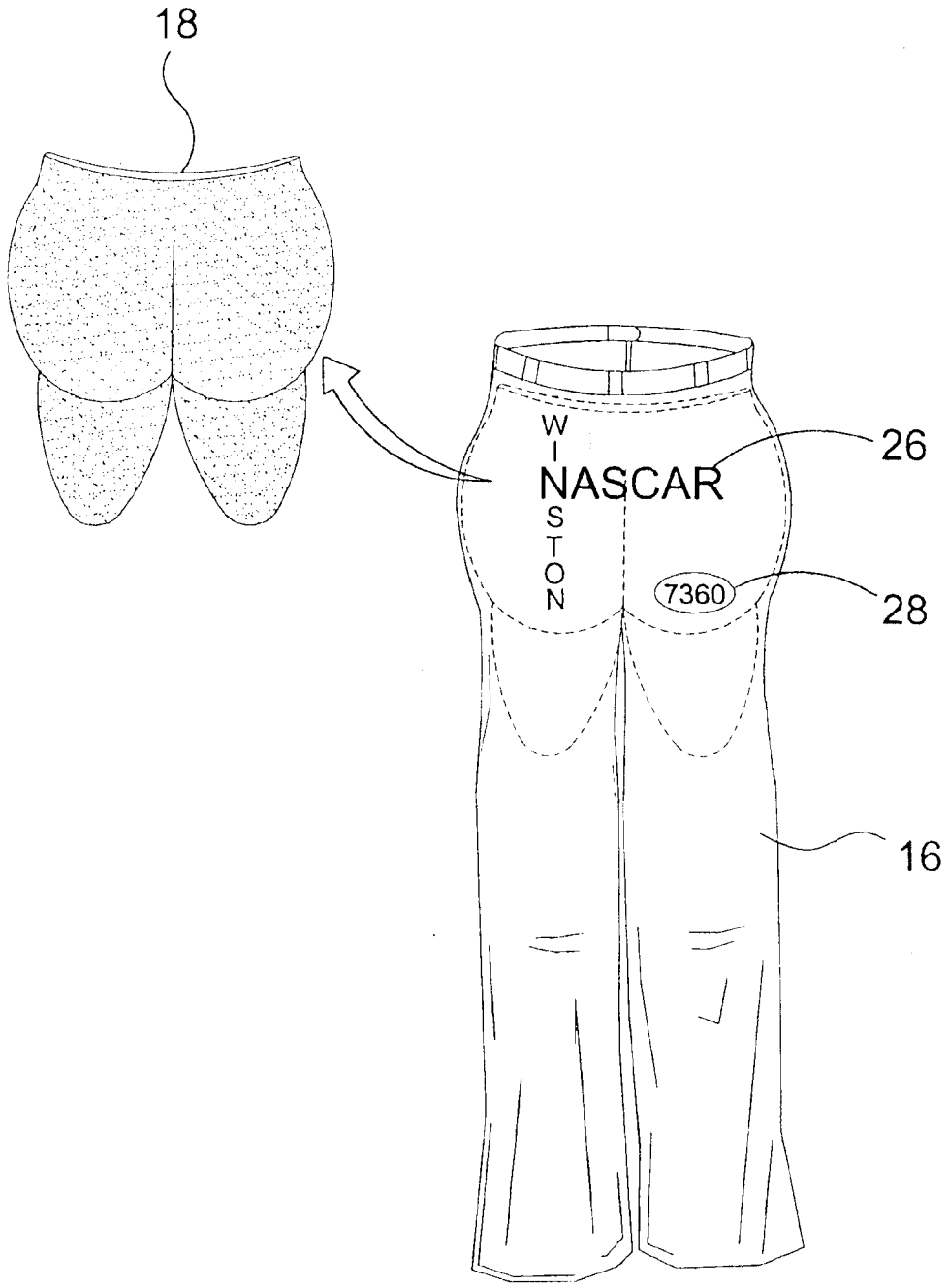
FIG. 6 is a rear view of the cushioned pants of the present invention.

Turning to FIG. 6, shown therein is a rear view of the cushioned pants 16 of the present invention. Shown is a rear view of the apparel of the present invention having a buttocks-shaped foam cushion 18 incorporated therein whereby the wearer when seated has a cushioning element between their buttocks and thighs and the seat. The padded apparel 16 could be worn for a wide variety of sporting events, such as NASCAR, football, basketball, soccer, baseball and hockey. The cushioned pants 16 are designed for all weather conditions using a variety of materials such as spandex, lycra, polyester/cotton, cotton, cotton denim and others. The pants 16 being either full length or shorts can have indicia and/or image(s) which may appear as team colors and logo and sport 26 printed on the outer material of the pants or an advertisement. The apparel can also consist of a set of unique numbers 28 identifying a unique garment whereby sporting event promoters can incorporate the unique identifier into a drawing for rewarding one or more sporting event attendees.

Figure 7:
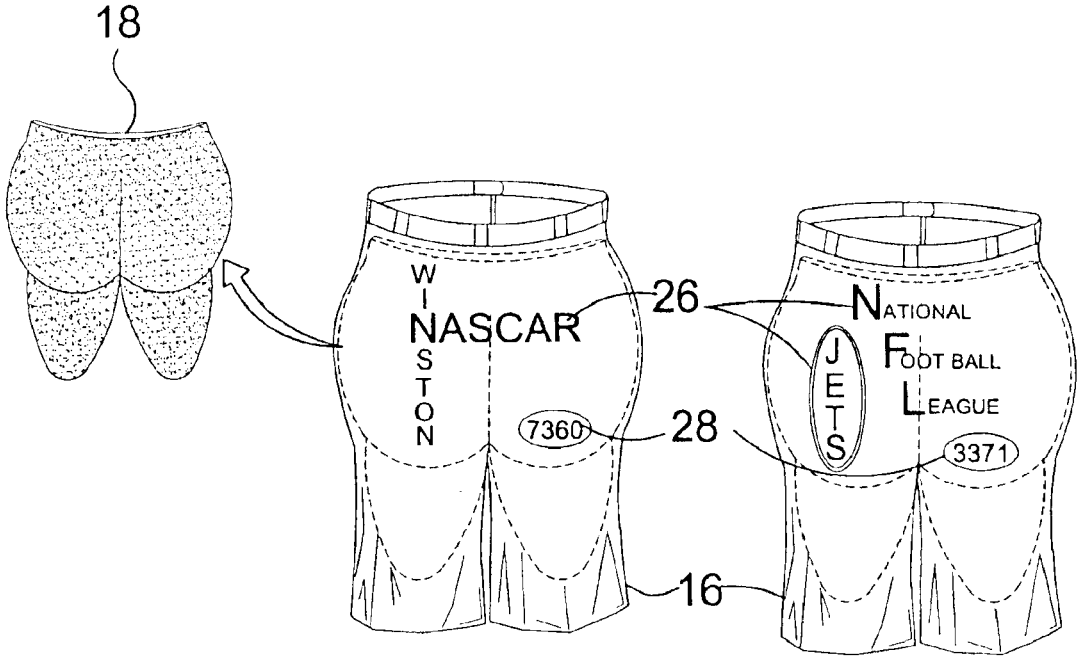
FIG. 7 is a rear view of the cushioned pants of the present invention.

Turning to FIG. 7, shown therein is a rear view of the cushioned pants 16 of the present invention. Shown are the short pants 16 version of the present invention, providing pants with built in cushions 18 for the buttocks and thighs. The pants 16 would provide comfort for the wearer and could be worn for a wide variety of sporting events, such as NASCAR, football, basketball, soccer, baseball and hockey. The pants 16 of the present invention would be marketed to consumers of all ages. The cushioned pants 16 are made for all weather conditions using a variety of materials such as spandex, lycra, polyester/cotton, cotton, cotton denim and others. The pants 16 will be provided in full length or shorts and can be accompanied by a matching cap and/or jacket. In addition, the pants 16 could comprise team colors and logo 26 printed on the outer material of the pants like an advertisement. The pants 16 can also consist of a set of unique numbers 28 identifying the wearer. For example, if at a football game, a spectator has their team pants on and that team wins the game and a identical number is drawn, then the winner is the fan with that number marked on their pants. If that team goes to the super bowl and wins, and your number is drawn, the winner could receive a prize. This can be done at any sports event.

Figure 8:
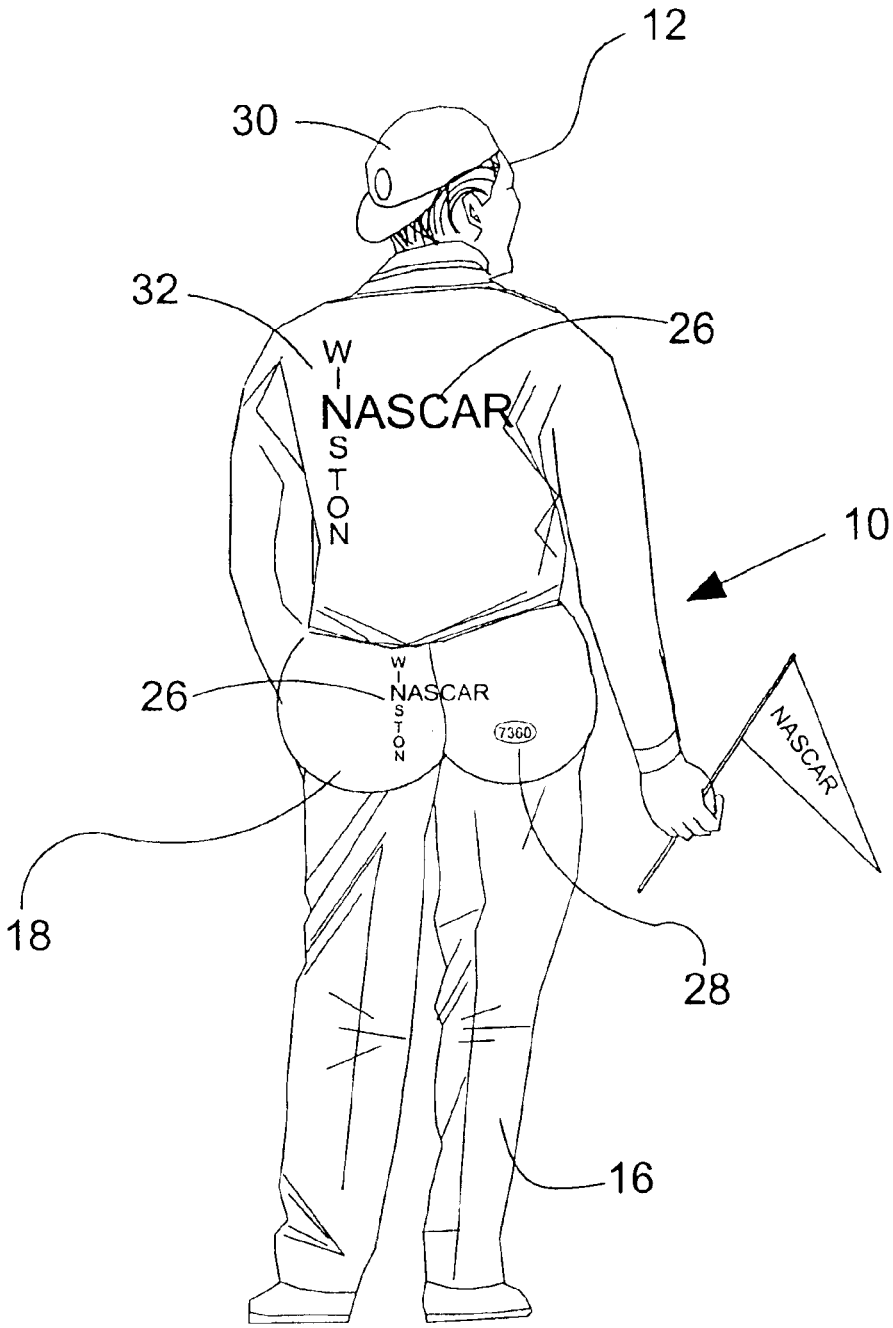
FIG. 8 is an illustrative view of the apparel of the present invention in use.

Turning to FIG. 8, shown therein is an illustrative view of the apparel of the present invention 10 in use. Shown is a user 12 wearing the buttocks padded pants 16 of the present invention 10 that provides a cushion 18 for the wearer when seated. The pants 16 can be manufactured from various materials such as spandex, lycra, polyester/cotton, cotton, cotton denim or other suitable material in either full length or shorts and can be accompanied by other apparel such as, matching cap 30 and/or jacket 32. In addition, the pants 16 could be manufactured in a style matching team colors or incorporate graphic images such as team logo 26 or other indicia. The aforementioned apparel can also be manufactured with a unique serial number 28 whereby sporting event promoters or other interested parties could manufacture and/or sell numbered apparel whereby attendance to events can be promoted by offering prizes for the wearers of the apparel by randomly drawing from a reservoir of numbers and awarding prize for those in attendance.

Figure 9:
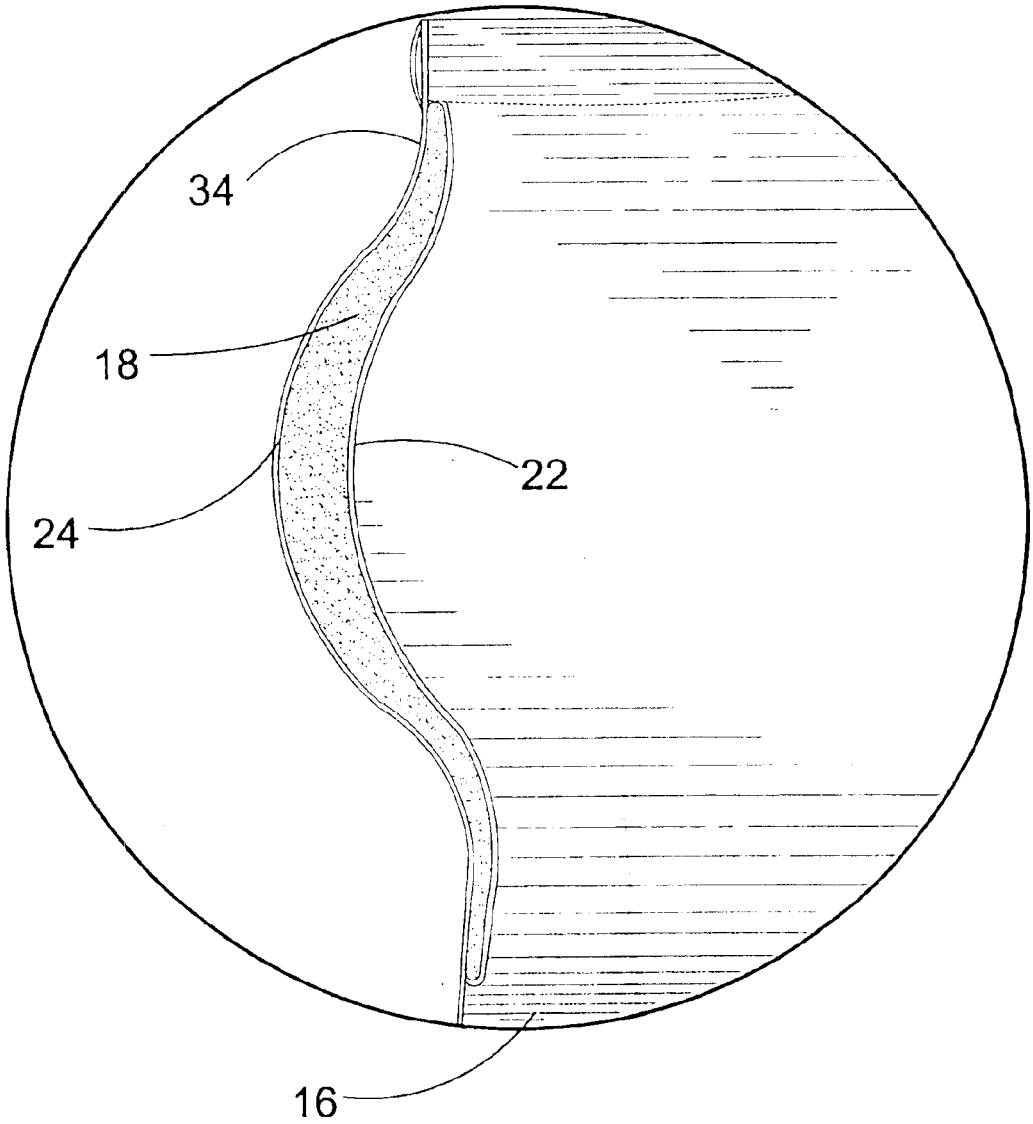
FIG. 9 is a sectional view of the cushioned pants of the present invention.

Turning to FIG. 9, shown therein is a sectional view of the cushioned pants 16, of the present invention. The present invention provides pants 16 with built in cushions for the buttocks and thighs having means 34, for example, bonding, adhesive or sewing, for fixedly attaching the foam rubber pad 18 to the pants material. The cushioned pants 16 are made for all weather conditions using a variety of materials such as spandex, lycra, polyester/cotton, cotton, cotton denim and others. The pants 16 will be provided in full length or shorts and can be accompanied by side pockets, waist band, rear pockets and foam rubber cushions 18 to protect the buttocks and thighs, and with team logo with a message announcing support for the team or advertisements. Also shown are inner material 22 and outer material 24.

I claim:

1. Apparel for providing padded pants to be worn by a user, comprising:

a) a pants, said pants sized to fit the user, wherein said pants have a buttocks and upper thigh area;

b) an inner and outer layer of material disposed in said buttocks and upper thigh area of said pants;

c) a seating cushion included in said pants for replacing a separate cushion on a seat comprising a foam cushion, said cushion having the shape of the buttocks and upper thigh area of the user, the cushion increasing in thickness from an outer edge of said cushion to a central location over said buttocks; and, d) wherein said cushion is disposed between said inner and outer layer of material in said buttocks and upper thigh area of said pants to provide padded pants for the user to sit on.

2. The apparel of claim 1, wherein said cushion is bonded between said inner and outer layer of material.

3. The apparel of claim 2, wherein said cushion is attached between said inner and outer layer of material using adhesive.

4. The apparel of claim 3, wherein said cushion is sewn between said inner and outer layer of material.

5. The apparel of claim 1 having a unique serial number disposed on said pants for identifying the user of said pants.

* * * * *